US006146187A

United States Patent [19]

Pallai

[11] Patent Number: 6,146,187

[45] Date of Patent: Nov. 14, 2000

[54] SCREWLESS TERMINAL BLOCK

[75] Inventor: Laszlo Antal Pallai, Ste Anne de Bellevue, Canada

[73] Assignee: Supplié & Co. Import/Export, Inc., Canada

[21] Appl. No.: 09/199,616

[22] Filed: Nov. 25, 1998

[51] Int. Cl.[7] ..... H01R 4/24

[52] U.S. Cl. ..... 439/441; 431/488; 431/439

[58] Field of Search ..... 439/441, 438, 439/439, 488, 491, 835, 436, 489

[56] References Cited

U.S. PATENT DOCUMENTS

| | | | |
|---|---|---|---|
| 3,152,851 | 10/1964 | McLaughlin | 439/441 |
| 3,474,389 | 10/1969 | Nagano | 439/440 |
| 4,759,726 | 7/1988 | Naylor et al. | 439/441 |
| 4,768,976 | 9/1988 | Gelati | 439/441 |
| 4,846,722 | 7/1989 | Heng et al. | 439/441 |
| 5,348,496 | 9/1994 | Ludwig | 439/441 |
| 5,449,300 | 12/1995 | Yoon | 439/441 |
| 5,685,735 | 11/1997 | Hohorst | 439/441 |
| 5,915,991 | 6/1999 | Roman | 439/441 |

FOREIGN PATENT DOCUMENTS

| | | | |
|---|---|---|---|
| 335 093 | 10/1989 | European Pat. Off. . | |
| 19 75 279 | 12/1967 | Germany . | |
| 2062158 | 7/1972 | Germany | 439/441 |
| 25 11 444 | 9/1976 | Germany . | |
| 2511444 | 9/1976 | Germany | 439/441 |
| 54-50992 | 4/1979 | Japan . | |
| 1-130480 | 5/1989 | Japan . | |
| 751675 | 7/1956 | United Kingdom . | |
| 0 831 557 | 3/1998 | United Kingdom . | |
| 2 321 790 | 8/1998 | United Kingdom . | |

*Primary Examiner*—Paula Bradley
*Assistant Examiner*—Tho D. Ta
*Attorney, Agent, or Firm*—Quarles & Brady LLP

[57] ABSTRACT

A screwless-type terminal block comprising a housing, a clamping member in the housing, a PCB conductive pin, and an actuating member. The housing defines a first opening for receiving therein a wire end and a second opening through which extends the actuating member which has a operating knob outside of the housing and a cammed end adapted to displace the clamping member between locked and unlocked positions thereof respectively for securing the wire end in an electrically conductive manner with the PCB pin and for allowing the wire end to be inserted in or withdrawn from the housing. When rotated, the operating knob causes the cammed end to rotate about a longitudinal axis of the actuating member such that the cammed end causes the clamping member to selectively displace between the locked and unlocked positions. The cammed end includes a flat surface angled with respect to the longitudinal axis and contacting the clamping member which displaces along a plane parallel to this longitudinal axis. The clamping is spring loaded such as to be biased towards the PCB pin. The operating knob and the housing are provided with visible indicators to indicate if the clamping member is in its locked or unlocked position. The terminal block is nestable in a side-by-side relationship with other similar terminal blocks.

19 Claims, 7 Drawing Sheets

SCREWLESS TERMINAL BLOCK

BACKGROUND OF THE INVENTION

1. Field of the Invention

The present invention relates to electrical terminal blocks and, more particularly, to a screwless electrical terminal block for quick wire attachment thereto and detachment therefrom.

2. Description of the Prior Art

There exists a series of different electrical terminal blocks. Some use screw connectors including a screw around which the wire is wrapped with the screw being then tightened to secure the connection. In the art of printed circuit boards, it is important that the terminal blocks be small as an alternative to screw-type connectors, various screwless terminal blocks have been developed in which typically a bare end of the electrical conductor is simply inserted in an opening defined in the housing of the terminal block with an internal resilient spring clip interfering with the opening and being capable of being deflected out of the way by the introduction of the bare conductor end into the housing. The resilience of the spring clip returns it into contact with the bare end such as to produce an electrically conductive contact with an interior terminal of the housing. The spring clip locks the bare conductor end into position in the terminal block. Various systems are proposed to release the spring clip from the conductor such as to remove the latter from the terminal block.

For instance, U.S. Pat. No. 5,348,496 issued to Ludwig on Sep. 20, 1994 discloses, as best seen in FIGS. 4 to 6 (and especially FIG. 6), a push-wire connection where a cantilevered leaf spring 34 is biased towards the contact wall 30 such as to imprison therebetween the stripped portion 24 of the wire. A release key 40 can be inserted through release passage 38 by way of a translational displacement to deflect the spring or finger 34 away from the contact wall 30 such as to allow the stripped wire portion 24 to be removed from the wiring device, as best seen in FIG. 6.

In U.S. Pat. No. 4,759,726 issued to Naylor on Jul. 26, 1998, there is shown in FIGS. 3 and 4 a generally U-shaped electrical terminal 32 having an upper gripping element 34 which is adapted to be displaced by cam-lever 42 such as to selectively imprison or release a wire 66 with respect to the electrical terminal 32. The cam-lever 42 operates as a pure pivot as opposed to your rotatable knob. In FIG. 6, there is shown a series of terminal blocks 10 connected in a multiple terminal.

In U.S. Pat. No. 3,152,851 issued to McLaughlin on Oct. 13, 1964, an actuating member 60 can be pivoted to displace a resilient arm 44 away or towards a housing abutment 54 such as to selectively imprison or release a wire 32 with respect to the wiring device 10.

In German Patent Publication No. 2511444 published on Sep. 23, 1976 to Marquardt, a push button 10 can be translationally displaced along arrow 11 of FIG. 1 such as to displace a spring member 15 between wire engagement and wire release positions, as respectively illustrated in FIGS. 2 and 3.

In European Patent Publication No. EP-335,093-A published on Oct. 4, 1969 to Feller AG, an operating element 10 can be pivoted (see FIGS. 1 and 2) such as to act on a U-shaped spring 7 for permitting a wire 4 to be inserted in the housing 1. The operating element 10 by its position, provides a visual indication of a correct contact between the wire lead 4 and the contact element 6 of the housing Japanese Patent Publication No. JP-A-54-50992 published on Apr. 21, 1979 in the name of Matsushita Denko K. K. shows various designs, including that of FIG. 13 where a cammed handle 4 is used on a spring 8 to hold wires in a housing.

Japanese Patent Publication No. JP-A-1-130480 published on May 23, 1989 to Matsushita Electric Works Ltd. discloses a quick connecting terminal device where an electrode wire 13 inserted in a hole 14 may be held in the housing by a lock spring 3. When the conductor 13 is completely inserted, its tip presses a U-shaped portion 6 of a sound emitting spring 5 and the sound so emitted ensures that the conductor 13 has been fully inserted in the terminal device.

British Patent Publication No. GB-751,675 published on Jul. 4, 1956 in the name of Arrow Electric Switches Limited illustrates in FIG. 1 a wire lead 17 held in a terminal block by a gripping member 30. Release holes 17 and 19 are provided in the sides of the housing such that a stiff and thin elongated element (e.g. a nail) inserted therethrough will displace the gripping element 30, by lever action, sufficiently such as to free the wire end 40.

SUMMARY OF THE INVENTION

It is therefore an aim of the present invention to provide a novel screwless terminal block.

It is another aim of the present invention to provide a screwless terminal block including a cammed actuating member for displacing a clamping member between engaged and release positions with respect to a wire conductor received in the terminal block.

It is a further aim of the present invention to provide a screwless terminal block wherein the actuating member includes a cam surface inside a housing of the terminal block with the actuating member being rotatable about a longitudinal axis thereof from outside of the housing.

It is still a further aim of the present invention to provide a screwless terminal block wherein a knob of the actuating member located outside of the housing of the terminal block provides visual indication as to whether or not the clamping member is in the engaged or release positions thereof.

It is a still further aim of the present invention to provide to a screwless terminal block which can be assembled in a nesting and side-by-side relationship with one or more similar terminal blocks for electrically connecting more than one conductor for instance to a printed circuit board.

Therefore, in accordance with the present invention, there is provided a screwless-type terminal block, comprising housing means defining first and second openings, clamping means in said housing means, conductor means, and actuator means, said housing means being adapted to receive therein a wire end through said first opening, said actuator means extending through said second opening and having an operable end outside of said housing means and a cammed end adapted to displace said clamping means between locked and unlocked positions thereof respectively for securing the wire end in an electrically conductive manner with said conductor means and for allowing the wire end to be inserted in or withdrawn from said housing means, said operable end being adapted to cause said actuator means to rotate about a longitudinal axis thereof such that said cammed end causes said clamping means to displace between said locked and unlocked positions.

Also in accordance with the present invention, there is provided a screwless-type terminal block, comprising housing means defining first and second openings, clamping means in said housing means, conductor means, and actuator means, said housing means being adapted to receive therein a wire end through said first opening, said actuator means extending through said second opening and having a operable end outside of said housing means and a cammed end adapted to displace said clamping means between locked and unlocked positions thereof respectively for securing the wire end in an electrically conductive manner with said conductor means and for allowing the wire end to be inserted in or withdrawn from said housing means, wherein said operable end and said housing means are provided with visible indicator means for allowing to determine from outside of said terminal block if said clamping means is in said locked or unlocked position thereof.

Further in accordance with the present invention, there is provided a screwless-type terminal block, comprising housing means defining first and second openings, clamping means in said housing means, conductor means, and actuator means, said housing means being adapted to receive therein a wire end through said first opening, said actuator means extending through said second opening and having a operable end outside of said housing means and a cammed end adapted to displace said clamping means between locked and unlocked positions thereof respectively for securing the wire end in an electrically conductive manner with said conductor means and for allowing the wire end to be inserted in or withdrawn from said housing means, said operable end being adapted to cause said clamping means to displace, between said locked and unlocked positions, along a plane substantially parallel to a longitudinal axis of said actuator means.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
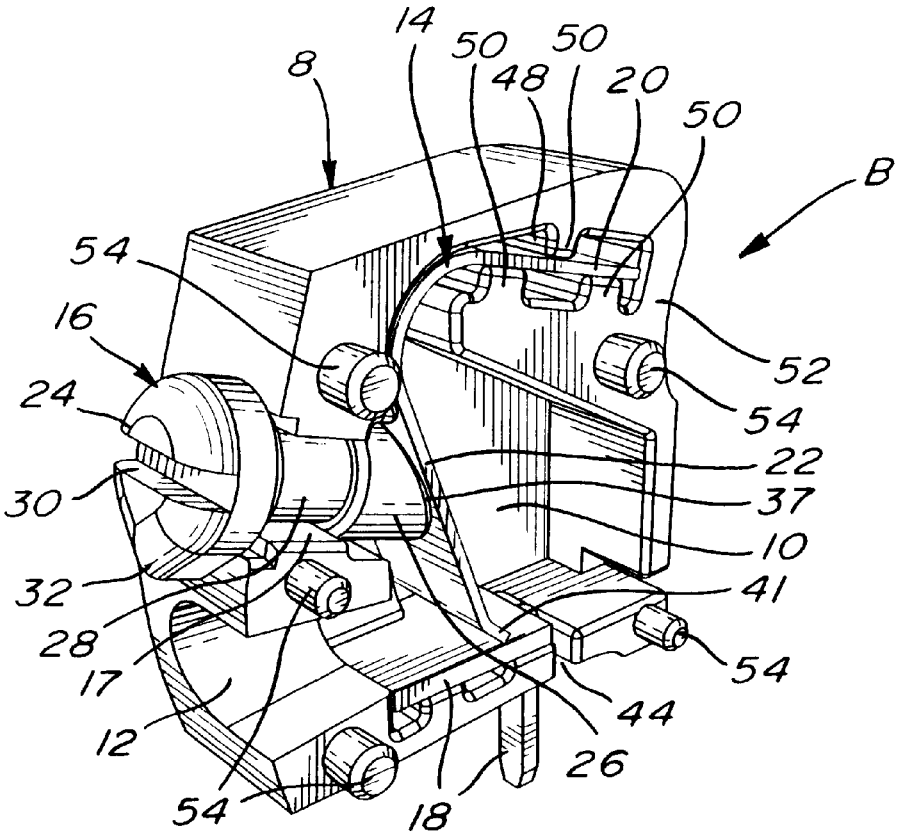
FIG. 1 is a perspective view of a screwless terminal block in accordance with the present invention.
Figure 2:
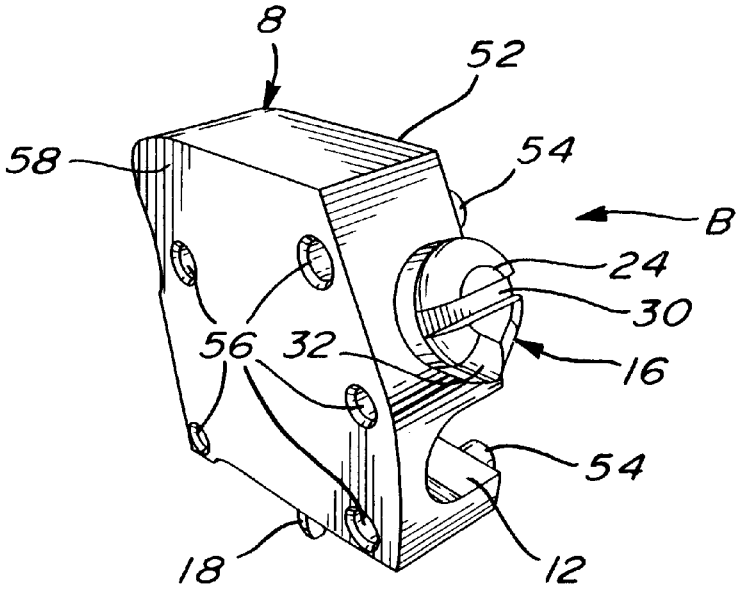
FIG. 2 is further perspective view of the screwless terminal block of FIG. 1.

In accordance with the present invention, there is provided a screwless terminal block B for connecting wires in an electrically conductive way, for instance, to printed circuit boards. The terminal block B is adapted to be secured to a circuit board and to electrically connect a cable or a wire thereto. The terminal block B comprises a housing 8 which defines a cavity 10 and a tapered guide opening 12 through which a wire W (see FIG. 4) may be inserted such as to have a bare or exposed end 13 thereof extending into the cavity 10. A resilient metallic clamping member 14, in the form a leaf spring, is mounted in the cavity 10 of the housing 8. An actuating member 16 extends though the housing 8 by way of a hole defined in the housing 8. An electrically conductive PCB (Printed Circuit Board) pin 18 extending in the cavity 10 and also outwardly of the housing 8 and thus of the terminal block B is provided for connection to the printed circuit board (not shown).

More specifically, the tapered configuration of the guide opening 12 facilitates the introduction of the exposed end 13 of the wire W into and through the guide opening 12.

The clamping member 14 has a first section 20 secured in position in the housing 8 and a second gripping section 22 which is adapted to be resiliently displaced by the selective rotation of the actuating member 16, as seen sequentially in FIGS. 3 to 6.

The actuating member 16 includes an outer operating knob 24, an inner cammed end 26 and an cylindrical intermediate section 28 journaled in the hole 17 for allowing rotation of the actuating member 16 about its central longitudinal axis. The operating knob 24 defines a diametrical slot 30 which may be engaged by a flat blade screwdriver, or the like, to selectively rotate the actuating member 16.

Figure 8:
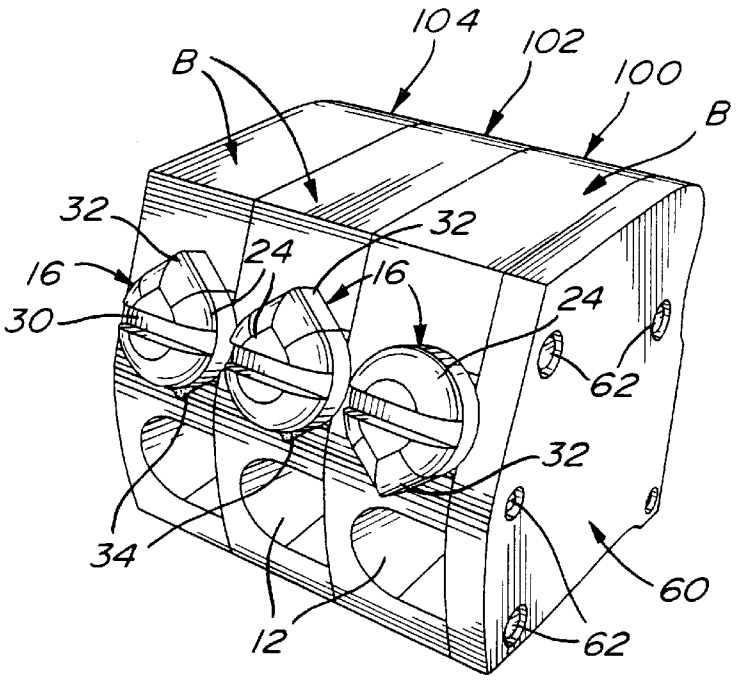
FIG. 8 is a perspective view showing the screwless terminal blocks and cover plate of FIG. 7 in a nested engaged position thereof.

As seen in FIGS. 1, 2, 7 and 8, the operating knob 24 preferably includes a pointed portion 32 to provide an indication from the outside of the relative position in the cavity 10 of the cammed end 26 of the actuating member 16. The teardrop-shaped operating knob 24, when pointing toward the wire receiving guide opening 12, indicates that the wire W is locked to the terminal block B. As best seen in FIG. 8, indicia 34 may be provided on the outside of the housing 8, adjacent to the operating knob 24 for use in concert with the pointed portion 32 to provide a clear visual indication of the state of the wire W within the terminal block B, i.e. whether or the wire W is locked to the terminal block B. Indicia 34 may take the form of a triangular textured matte finish on the housing 8. Typically, alignment of the pointed portion 32 with the indicia indicates a locked position of the wire W.

Figure 3:
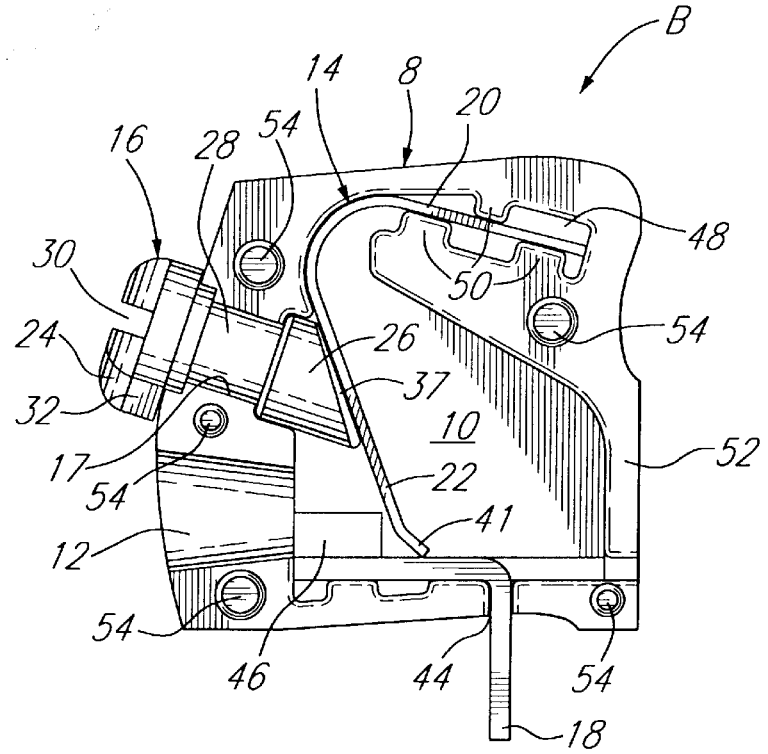
FIG. 3 is a side elevational view of the screwless terminal block without a conductor inserted therein.
Figure 4:
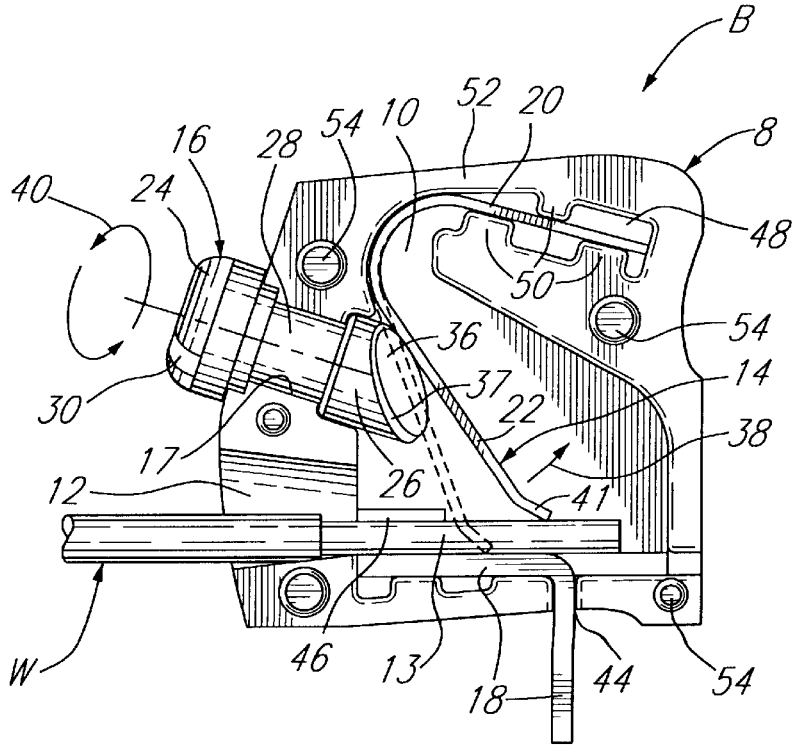
FIG. 4 is,a side elevational view of the screwless terminal block, similar to FIG. 3, but with a conductor being securely inserted therein.
Figure 5:
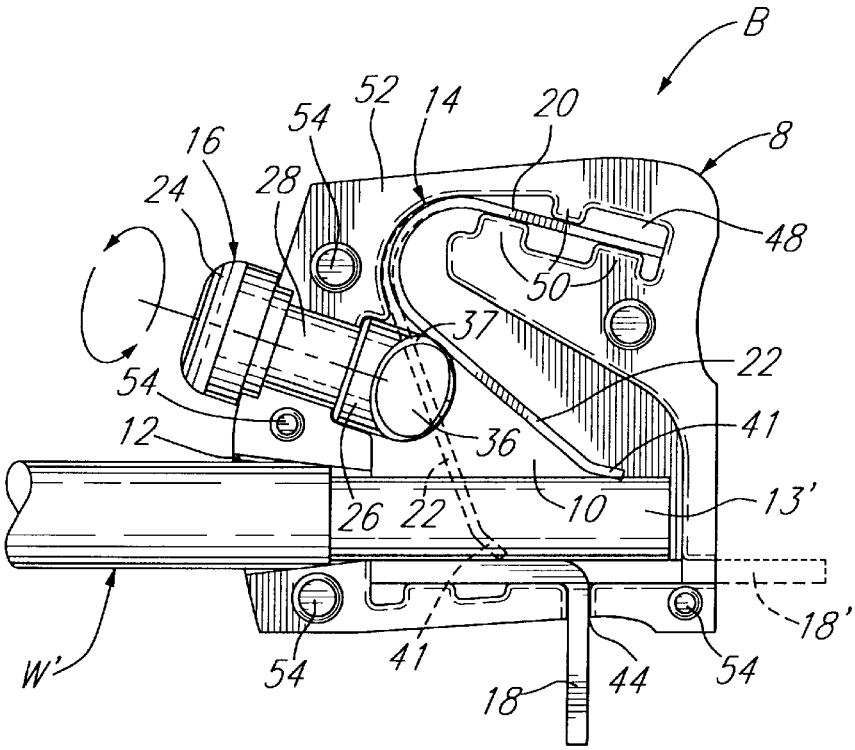
FIG. 5 is a side elevational view of the screwless terminal block, similar to FIG. 4, but with a larger conductor being inserted therein.
Figure 6:
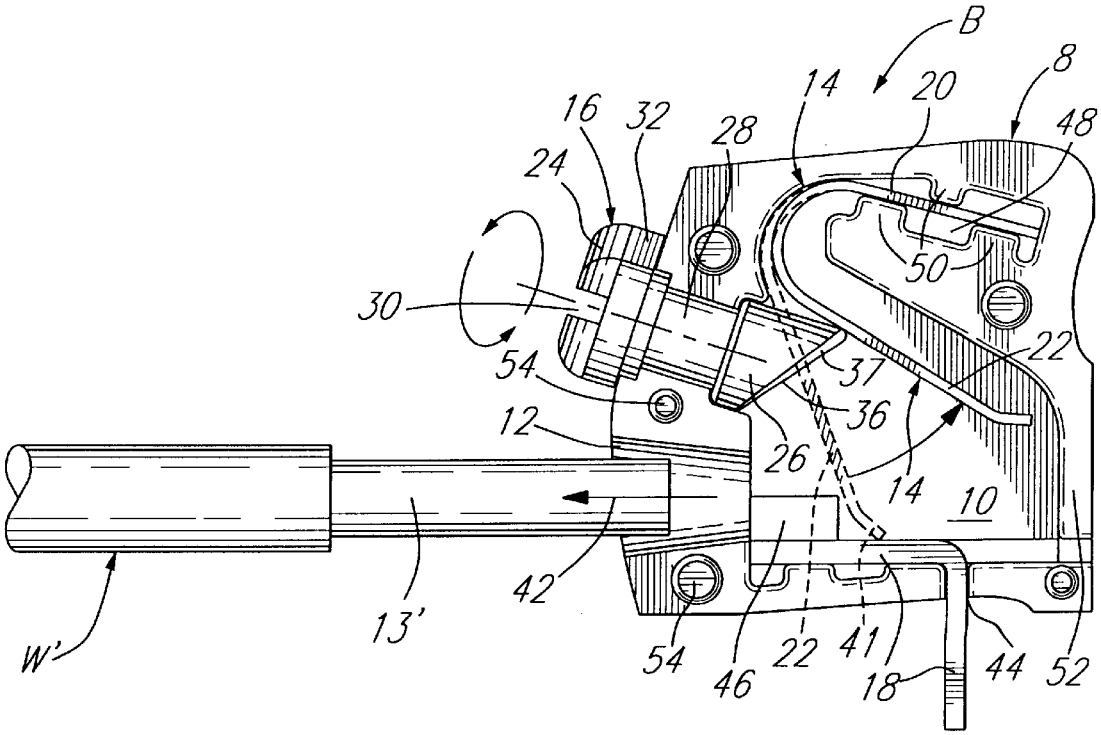
FIG. 6 is a side elevational view of the screwless terminal block showing the removal of the conductor therefrom.

The cammed end 26 of the actuating member 16 has the form a truncated cylinder including a free end defining a substantially flat surface 36 extending in a plane intersected at an angle by the longitudinal axis of the actuating member 16 and having a peripheral edge 37 along which the gripping section 22 displaces upon rotation of the actuating member 16, as well seen sequentially in FIGS. 4 to 6. The gripping section 22 of the clamping member 14 is spring biased against this flat surface 36. The angled configuration of the cammed end 26 allows for a gradual displacement or deflection of the gripping section 22 with respect to the PCB pin 18 as the actuating member 16 is rotated, as again clearly illustrated throughout FIGS. 3 to 6.

Therefore, the actuating member 16 may be rotated to displace the gripping section 22 of the clamping member 14 upwardly along arrow 38 (see FIG. 4) and against its resiliency such as to provide a sufficient gap between a gripping end 38 of the gripping section 22 of the clamping member 14 and the PCB pin 13. More specifically, FIG. 3 shows the gripping section 22 in its lowermost position, wherein it bears directly on the PCB pin.

To introduce the exposed end 13 of the wire w between the gripping section 22 and the PCB pin 18, the actuating member 16 must be rotated along arrows 40 of FIG. 4, using the operating knob 24, such that the rotation of the cammed end 26 displaces gradually the gripping section 22 upwardly away from the PCB pin 18, as illustrated in FIGS. 4 to 6. FIG. 6 shows the gripping section 22 in its uppermost position as the angled flat surface 36 is inverted relative to its position shown in FIG. 3. Once the exposed end 13 of the wire W has been properly positioned in the cavity 10 of the housing 8, the actuating member 16 is rotated to release the gripping section 22 and allow it, under its own bias, to pivot downwardly onto the exposed end 13 in a locked position, as seen in full lines in FIG. 4. The gripping section 22 includes a gripping end 41 in the form of a bend and this allows for the use of a large range of wire sizes while still retaining the retention force required under CSA specifications. For a larger wire W' having exposed end 13', the locked position of the gripping section 22 on the exposed end 13 is obviously different, as exemplified by FIG. 5.

To remove the wire W/W' from the terminal block B, the actuating member 16 is again rotated to raise the gripping section 22 out of engagement with the wire's exposed end 13/13', and the wire can then be withdrawn from the cavity 10, as per arrow 42 of FIG. 6.

Obviously, the cammed end 26 is rotated sufficiently to provide the clearance required to allow the wire w to be introduced between the gripping section 22 and the PCB pin 18. Therefore, for wires having sufficiently small diameters, the cammed end 26 does not need to be necessarily displaced to its position illustrated in FIGS. 5 or 6.

To ensure that the gripping section 22 is locked onto the exposed end 13/13', it is preferable to return the actuating member 16 to its initial position, that is the position thereof illustrated in FIG. 3 thereby ensuring that the cammed end 26 does not interfere with the spring bias induced downward return of the gripping section 22 onto the wire, as this may prevent a proper locking of the wire within the terminal block B. Locking will be ensured by aligning the pointed portion 32 of the operating knob 24 with the indicia 34 provided on the exterior of the housing 8; this further allows for one to readily recognize if the gripping section 22 is in a locked or unlocked position thereof with respect to the wire, exposed end 13/13'. For instance, with reference to FIG. 8 which shows a series of three terminal blocks B in nesting relationship but without showing any wires therein for illustration purposes, it is clear that the right-hand-most terminal block 100 has its clamping member 14 in a locked position, whereas the central and left-hand-most terminal blocks 102 and 104 are in unlocked positions as their pointed portions 32 extend upwards, that is opposite the indicia 34; in fact the terminal blocks 102 and 104 are shown with their clamping members 14 in the position of that of FIG. 6.

Accordingly, the actuating member 16, when rotated, acts as a cam, by way of its cammed end 26, to displace the gripping section 22 of the clamping member 14 between clamping positions (FIGS. 4 and 5) and release positions( e.g. in FIG. 6). In the position illustrated in FIG. 6, the gripping section 22 is sufficiently spaced from the PCB pin 18 to allow for the wire W/W' to be passed through the guide opening 12 and into the cavity 10, such that when the operating knob 24 is rotated into its position shown in FIG. 3, the gripping section 22 of the clamping member 14 resiliently bears down on to the wire W/W' such as to imprison the same between the clamping member 14 and the PCB pin 18.

Construction-wise, the housing 8 is open on a first side 52 thereof and this allows for various components of the terminal block B to be easily inserted and positioned therein. For instance, the housing 8 includes a slot 44 and a retention tab 46 to slidably receive the conductive PCB pin 18 and ensure a proper position thereof in the housing 8. Also, to position the clamping member 14 in the terminal block B, the first section 20 of the clamping member 14 is also deposited into position in slot 48 defined in the housing 8 as an extension of the cavity 10, and is held in place thereat by ribs 50.

Figure 7:
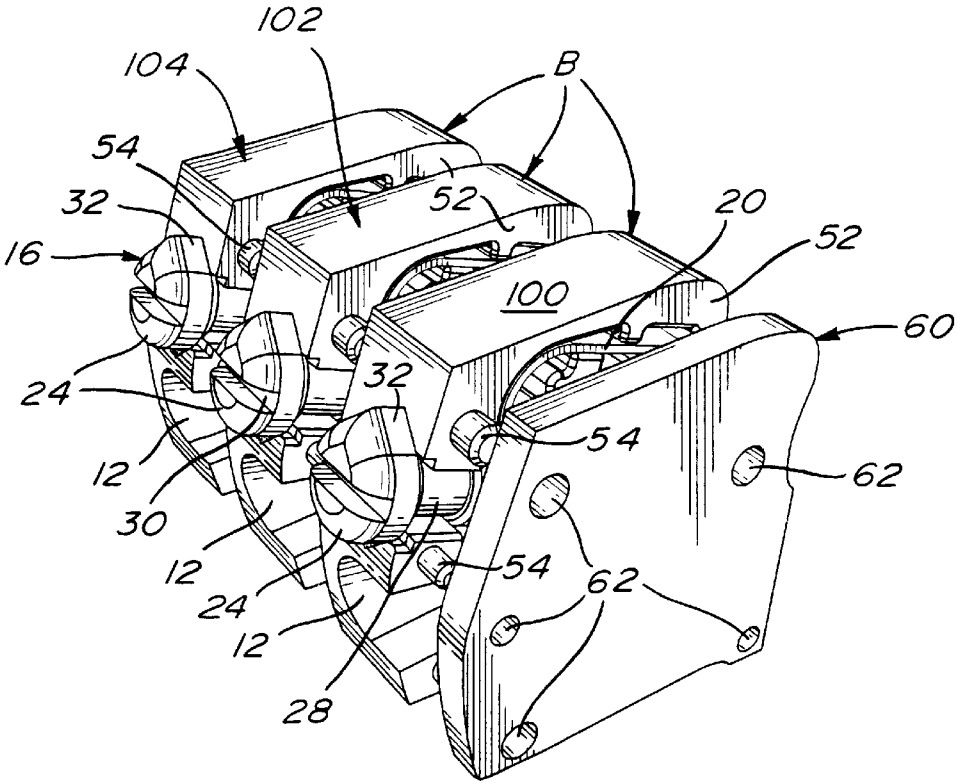
FIG. 7 is a perspective view illustrating a series of screwless terminal blocks, as individually illustrated in FIG. 1, and of a cover plate therefor, all shown prior to their assembly together.

The open side 52 of the terminal block B defines a series of pins 54 which are adapted to mate into corresponding apertures 56 defined in the other side 58 of the terminal block B such that a desired number of blocks B can be juxtaposed in a nested relationship, as required, that is for accommodating and separately electrically connecting the desired number of wires to the printed circuit board, or the like. For example, FIGS. 7 and 8 show three such terminal blocks B in disassembled and assembled positions, respectively. A cover plate 60 is provided to close off the end terminal block 100 having its open end 52 exposed. the cover plate 60 defines apertures 62 for receiving the pins 54 of the terminal block 100. The pins 54 and the apertures 56 and 62 may also be designed such that there is a snapped engagement therebetween.

Accordingly, the present terminal block B provides a new locking mechanism comprised mainly of the clamping member 14 and the actuating member 16 in which the actuating member 16 allows for one to open the wire entry to receive stranded or small size solid wires. After wire insertion, the operating knob 24 is turned to close the spring or clamping member 14 on the wire W/W'. The operating knob 24 preferably has indicia thereon such that one can at a glance ascertain whether or not the terminal block B is in a wire locking position or in a wire releasing position thereof. various sizes of wires can be easily accommodated with various positions of the cammed end 26 of the actuating member 16 and especially in view of the resiliency of the clamping ember 14 which within a range of positions is able to properly grip the exposed end 13/13' of the wire W/W', as shown in FIGS. 3 to 6.

When large gauge wires are used, the wires are strong enough that they can be directly translationally introduced in the guide opening 12, i.e. without rotating the actuating member 16, forcibly causing themselves the gripping section 22 to displace upwardly to accommodate the wire therebelow.

Figure 9:
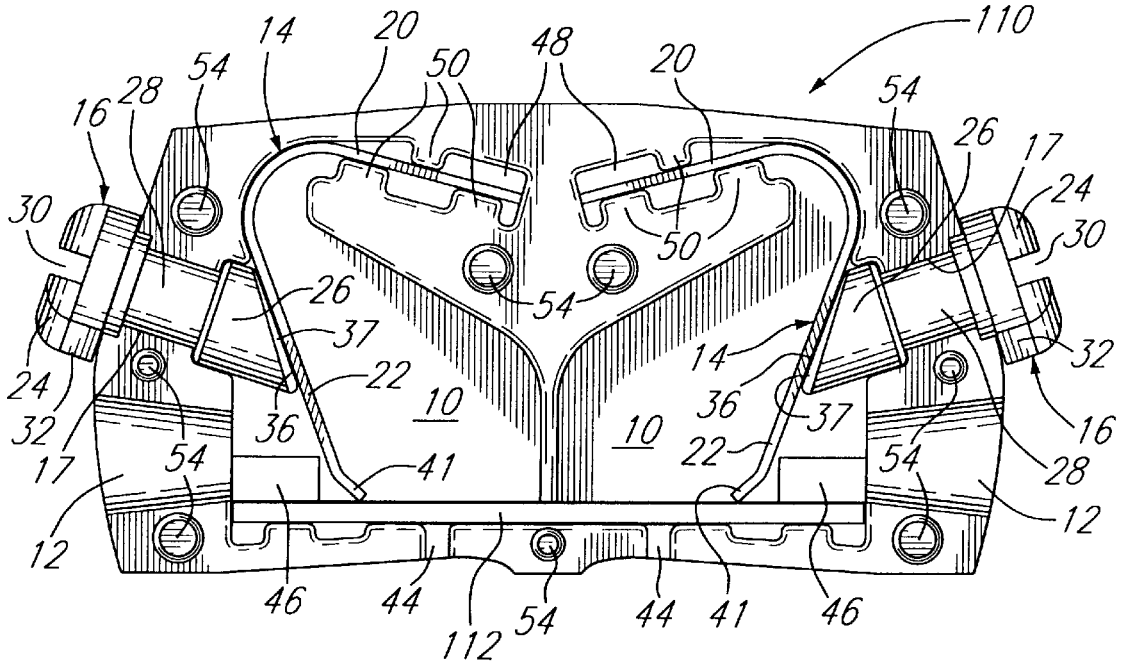
FIG. 9 is a side elevational view of a second embodiment of a screwless terminal block in accordance with the present invention for use in dual wire connections.

FIG. 9 shows a terminal block 110 which is substantially like a double version of the terminal block B, but which is capable of receiving two wires and electrically connecting the same together, using a common pin 112. The terminal block 110 can be used in panel/chassis applications.

Figure 10:
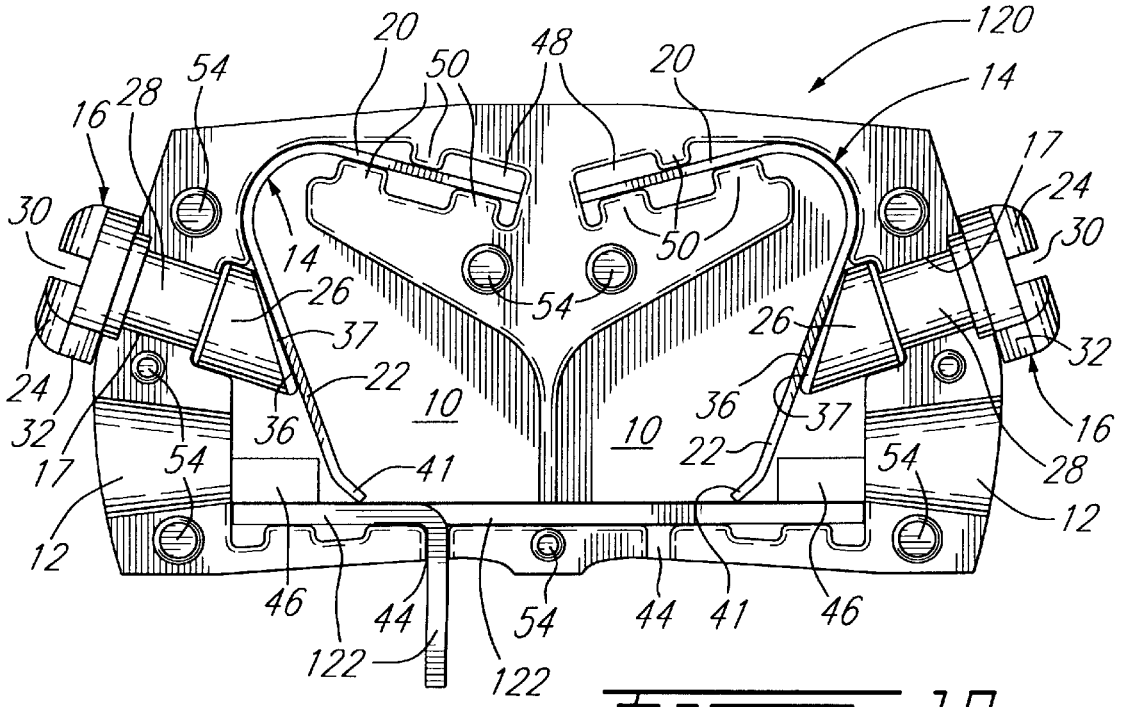
FIG. 10 is a side elevational view of a third embodiment of a screwless terminal block in accordance with the present invention which is a variant of the terminal block of FIG. 9.

FIG. 10 shows a terminal block 120 similar to terminal block 110 of FIG. 9, but where a pin 122 connecting both wires received in the block 120 is adapted for connection to printed circuit boards. It is thus like the double version of FIG. 9 but with the pin connection of FIGS. 1 to 8.

Figure 11:
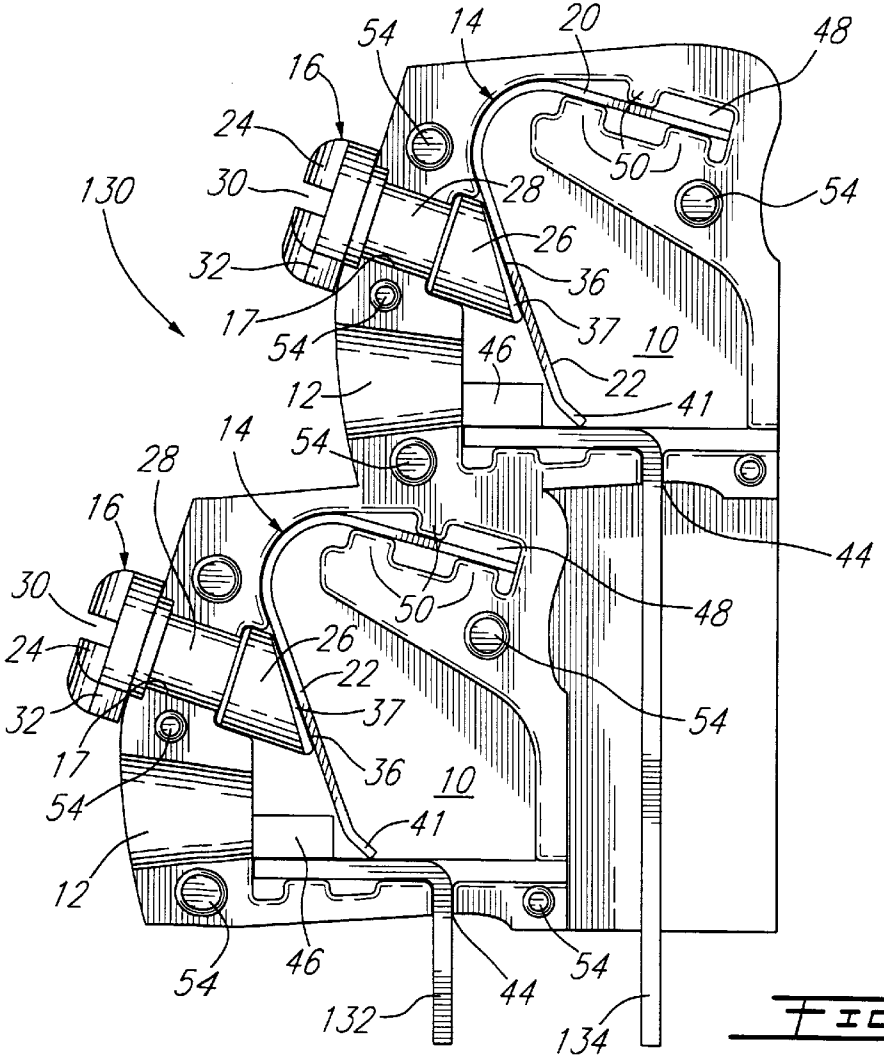
FIG. 11 is side elevational view of a fourth embodiment of a screwless terminal block in accordance with the present invention which is a second variant of the terminal block of FIG. 9.

FIG. 11 shows a double level terminal block 130 for use on printer circuit boards and having a pair of distinct and separate pins 132 and 134 for possibly connecting the two wires to different conductors.

Figure 12:
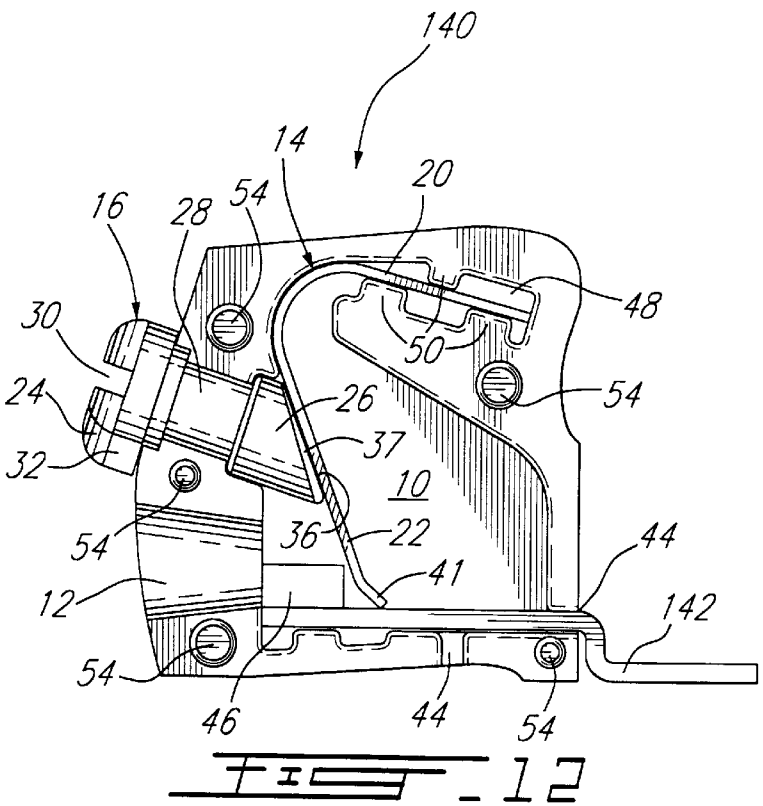
FIG. 12 is a fifth embodiment of a screwless terminal block in accordance with the present invention which is a first variant of the terminal block of FIG. 1.

FIG. 12 illustrates a surface-mount terminal block 140 having a pin 142 extending horizontally out of the block 140 instead of vertically as in the terminal block B of FIGS. 1 to 8.

Figure 13:
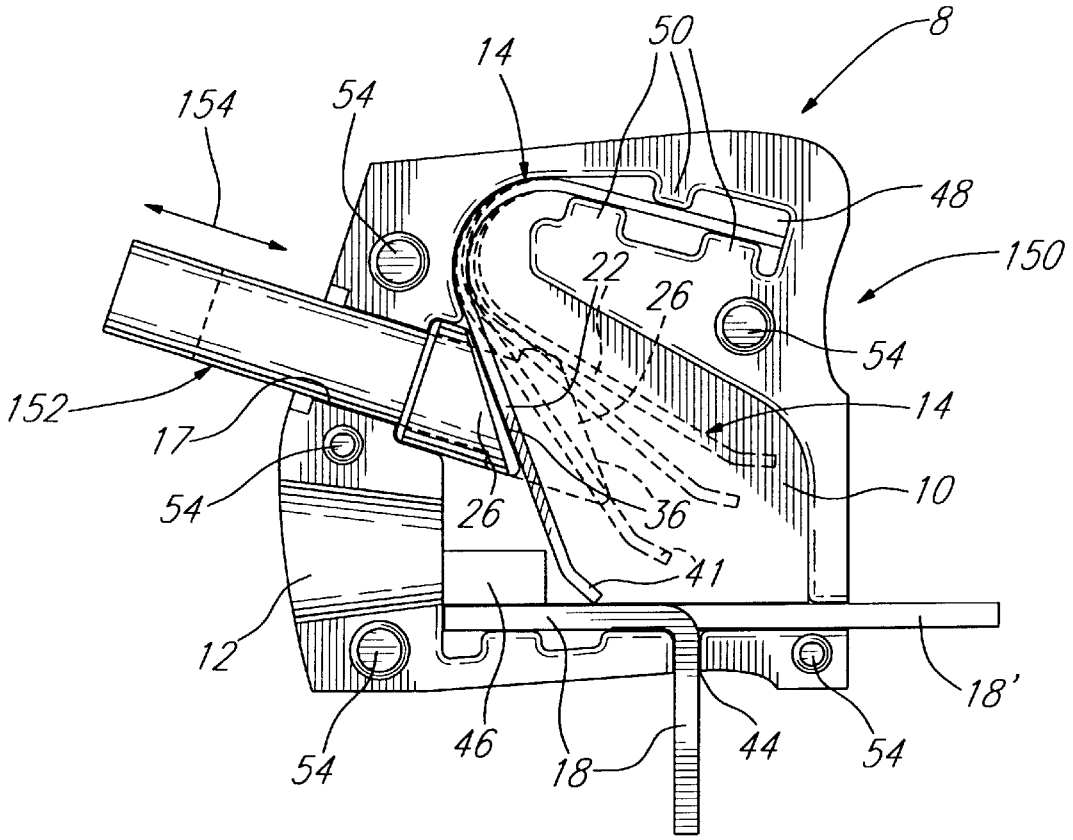
FIG. 13 His a side elevational view of a sixth embodiment of a screwless terminal in accordance with the present invention which is similar to FIG. 1 but wherein a clamping thereof is translationally displaceable instead of being rotatable.

FIG. 13 shows a terminal block 150, similar to the terminal block B of FIGS. 1 to 8, but wherein an actuating member 152 thereof is of the push-button type in that, as opposed to the rotary actuating member 16 of terminal block B, the actuating member 152 must be displaced axially along arrows 154 to move the clamping member 14. Basically, the actuating member 152 is pushed towards the housing 8 to raise the clamping member 14 (either to then introduce a wire in the terminal block 150, or to release the same therefrom), while the spring bias of the clamping member 14 returns the actuating member 152 outwardly of the housing 8, upon release of the actuating member 152, that is until the clamping member 14, in its downwards movement, abuts a wire, or the PCB pin 18 when no wire is present in the housing 8. The force of the clamping member 14 will thus keep the terminal block 150 in a normally closed position.

Pin 18' in FIG. 13 may be used for mounting the terminal block 150 to a vertical PCB. Such a pin 18' may also be adapted to other terminal blocks, such as terminal block B of FIGS. 1 to 8.

Terminal blocks of different colors can be used to identify functions in applications. For instance, green colored blocks can indicate ground connections, while red, black and blue blocks can be used to identify different phases along the standards of the industry.

The operating knob 24 can be of a different color than the rest of the terminal block to provide a higher contrast thereby facilitating the identification of the open/release or closed/locked position of the terminal block.

I claim:

1. A screwless-type terminal block, comprising housing means defining first and second openings, clamping means in said housing means, conductor means, and actuator means, said housing means being adapted to receive therein a wire end through said first opening, said actuator means extending through said second opening and having an operable end outside of said housing means and a cammed end adapted to displace said clamping means between locked and unlocked positions thereof respectively for securing the wire end in an electrically conductive manner with said conductor means and for allowing the wire end to be inserted in or withdrawn from said housing means, said operable end being adapted to cause said actuator means to rotate about a longitudinal axis thereof such that said cammed end causes said clamping means to displace between said locked and unlocked positions said cammed end having an angled surface intercepting said longitudinal axis, said angled surface contacting said clamping means.

2. A terminal block as defined in claim 1, wherein said first opening being frusto-conically shaped, tapering from the outside in for facilitating the introduction of the wire end in said housing means.

3. A terminal block as defined in claim 1, wherein said operable end comprises an operating knob defining a recess for receiving a screwdriver end for rotating said actuator means.

4. A terminal block as defined in claim 1, wherein said housing means define a third opening, said conductor means extending through said third opening for engagement to a printed circuit board.

5. A terminal block as defined in claim 1, wherein said clamping means, between said locked and unlocked positions displace along a plane, said plane being parallel to said longitudinal axis of said actuator means.

6. A terminal block as defined in claim 5, wherein said clamping means comprise a first section fixed in said housing means and an integral second section pivotable between said locked and unlocked positions and adapted for gripping the wire end in said locked position.

7. A terminal block as defined in claim 6, wherein said second section comprises at a free end thereof a bent gripping end extending at an angle with respect to an axis of the wire end which is smaller than that of a remainder of said second section.

8. A terminal block as defined in claim 6, wherein said second section is spring loaded such as to be biased towards said conductor means and being displaceable away from said c on duct or means to said unlocked position upon rotation of said actuator means.

9. A terminal block as defined in claim 8, wherein said surface is substantially flat, said second section in said locked position extending along said flat surface, whereby upon rotation of said actuator means, a peripheral edge of said flat surface causes said second section to displace away from said conductor means.

10. A terminal block as defined in claim 1, wherein said operable end and said housing means are provided with visible indicator means for allowing to determine from outside of said terminal block if said clamping means is in said locked or unlocked position thereof.

11. A terminal block as defined in claim 10, wherein said indicator means comprise first and second indicators defined on said operable end and said housing means, wherein when said first and second indicators are positioned oppositely adjacent to each other, said clamping means is in said locked position.

12. A terminal block as defined in claim 1, wherein said housing means is open on a first side thereof opposite a second side thereof which is substantially planar and which extends substantially parallel to the wire end, cover means being provided for closing said first side, wherein more than one of said terminal block may be positioned in a side-by-side relationship such that said second side of one said terminal block closes a first side of an adjacent terminal block, said cover means closing said first side of an end terminal block.

13. A terminal block as defined in claim 12, wherein said first and second sides are provided with matable corresponding pins and holes for nesting the terminal blocks in said side-by-side relationship, said cover means being also matable with said first side.

14. A terminal block as defined in claim 12, wherein said actuator means, said clamping means and said conductor means are slidably insertable in position in said housing means through said first side.

15. A terminal block as defined in claim 1, comprising in said housing means a pair of first openings to receive a pair of wire ends, and a clamping means and an actuator means for each wire end.

16. A terminal block as defined in claim 15, wherein said conductor means is common to both wire ends for electrically connecting the two wire ends using said terminal block.

17. A screwless-type terminal block, comprising housing means defining first and second openings, clamping means in said housing means, conductor means, and actuator means, said housing means being adapted to receive therein a wire end through said first opening, said actuator means extending through said second opening and having an operable end outside of said housing means and an inside end adapted to displace said clamping means between locked and unlocked positions thereof respectively for securing the wire end in an electrically conductive manner with said conductor means and for allowing the wire end to be inserted in or withdrawn from said housing means, wherein said operable end and said housing means are each provided with contrasting visible indicator means positioned in a substantially facing relationship to each other for allowing to determine from outside of said terminal block if said clamping means is in said locked or unlocked position thereof.

18. A terminal block as defined in claim 17, wherein said indicator means comprise mobile and fixed indicators defined respectively on said operable end and said housing means, wherein when said operable end is rotated such that said mobile and fixed indicators are positioned oppositely adjacent to each other, said clamping means is in said locked or unlocked position.

19. A terminal block as defined in claim 18, wherein said mobile indicator comprises a pointed element defined on said operable end and oriented opposite a longitudinal axis of said actuator means, wherein when said fixed indicator is adjacently aligned with said pointed element, said clamping means is in said locked position.

* * * * *